US005748081A

United States Patent [19]

Lin

[11] Patent Number: 5,748,081

[45] Date of Patent: May 5, 1998

[54] MULTI-FUNCTIONAL ANTI-THEFT SUPERVISING ASSEMBLY

[76] Inventor: Edward Lin, 1F, 359 Chung-Yang N. Rd. Sec. 2, Pei-Tou, Taipei, Taiwan

[21] Appl. No.: 638,586

[22] Filed: Apr. 29, 1996

[51] Int. Cl.[6] ..... G08B 13/18

[52] U.S. Cl. ..... 340/555; 340/330; 340/326; 340/632; 379/43; 379/44

[58] Field of Search ..... 340/555, 330, 340/320, 326, 311.1, 286.11, 632; 348/143; 379/34, 35, 43, 44, 441

[56] References Cited

U.S. PATENT DOCUMENTS

| | | | |
|---|---|---|---|
| 4,851,811 | 7/1989 | Vallat et al. | 340/326 |
| 5,144,661 | 9/1992 | Shamosh et al. | 380/9 |
| 5,210,520 | 5/1993 | Housley | 340/326 |
| 5,382,943 | 1/1995 | Tanaka | 340/539 |
| 5,420,567 | 5/1995 | Schwarz | 340/521 |

*Primary Examiner*—Thomas Mullen
*Assistant Examiner*—Anh La
*Attorney, Agent, or Firm*—Beveridge, DeGrandi, Weilacher & Young, LLP

[57] ABSTRACT

A multi-functional anti-theft supervising assembly which has an overall configuration of a telephone, includes an anti-theft controller, a video monitoring circuit, a dialogue controlling circuit and an infrared detecting circuit. A monitoring window, screen and a handset are provided as well. The anti-theft controller is connected with a plurality of signal detecting circuits externally and an infrared detecting circuit, accordingly, the signal of anti-theft, flameproof, gas-leakage can be transmitted to the hoist computer located at the control center for suitable reaction. The video controlling circuit and screen can be connected with the camera disposed at the front door. The dialogue circuit is connected as well. The dialogue circuit and said handset are interconnected with said video controlling circuit. A door lock release circuit is connected as well. The human being movement monitoring window is disposed at said assembly, by the connection between said infrared and anti-theft circuit, the signal collected can be transmitted accordingly, and suitable reaction can be made.

10 Claims, 3 Drawing Sheets

MULTI-FUNCTIONAL ANTI-THEFT SUPERVISING ASSEMBLY

BACKGROUND OF THE INVENTION

This invention relates to a supervising assembly, more particularly, to a multi-functional anti-theft supervising assembly which features an anti-theft controller, a video monitoring circuit, a dialogue controlling circuit and an infrared sensor.

DESCRIPTION OF PRIOR ART

The commercially available anti-theft assembly is equipped with simple functions, such as the dialogue between the house holder and the visitor at front door, and releasing the door lock remotely. Furthermore, this dialogue can only be made between the house holder and the visitor, no dialogue can be between the house holders who live in the same building. Accordingly, this commercially available supervising assembly can not meet the requirements for modern living.

On the other hand, the conventional anti-theft assembly includes a hoist alarm and a plurality of sensors which are individually mounted. Nevertheless, the installation of those items are not cost effective. On the other hand, the installation of said items will damage the decoration indoors. Furthermore, this separately mounted system can be readily by the intruder. In case the installation is not correct, mis-alarm will be triggered always.

SUMMARY OF THE INVENTION

It is the object of this invention to provide a multi-functional anti-theft supervising assembly which features an anti-theft controller, a video monitoring circuit, a dialogue controlling circuit and an infrared sensor.

It is still the object of this invention to provide the supervising assembly which provides a readily access to the visitor at the front door.

It is still the object of this invention to provide the supervising system which provides a dialogue system between the house holders which live in the same building as well as the guard in the control center.

In order to achieve the object set forth, the supervising assembly made according to this invention generally includes and anti-theft, flameproof, and gas-leakage detecting capabilities. In case of accident, said sensor will issue a signal and said signal will be sent to a host computer of the control center via a network. Accordingly, the guard can conduct a suitable reaction to those accidental cases.

The video monitoring circuit is interconnected to the camera located at the door, and accordingly, the house holder can supervise the situation at the front door. On the other hand, said dialogue controlling circuit is also interconnected with the speaker/microphone disposed on the front door. By this arrangement, not only will the house holder speak to the visitor at the front door, but also, the house holder will speak to the guard at the control center or the other house holder lives in the same building. Besides, said infrared sensor will detect any kind of heat emission within its scanning range. Said infrared sensor is also interconnected with said anti-theft controller. In case of any intruder or unauthorized break-in, said infrared sensor will issue a signal to advise the guard in control center, as a result, those troublesome, unwanted problems can be effectively avoided in advance.

DETAILED DESCRIPTION OF PREFERRED EMBODIMENT

Figure 1:
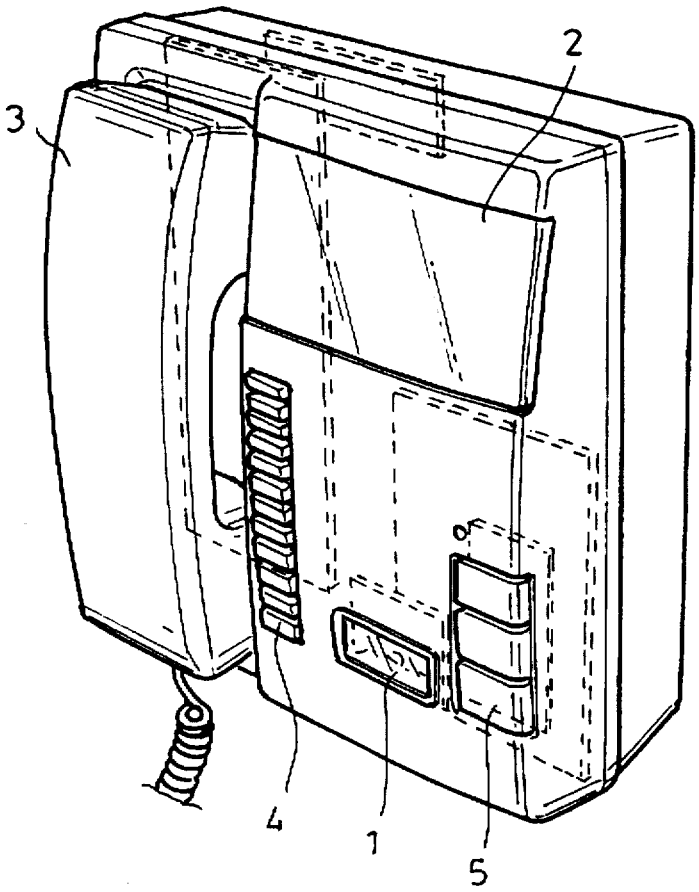
FIG. 1 is an exploded perspective view of the supervising assembly made according to this invention.
Figure 2:
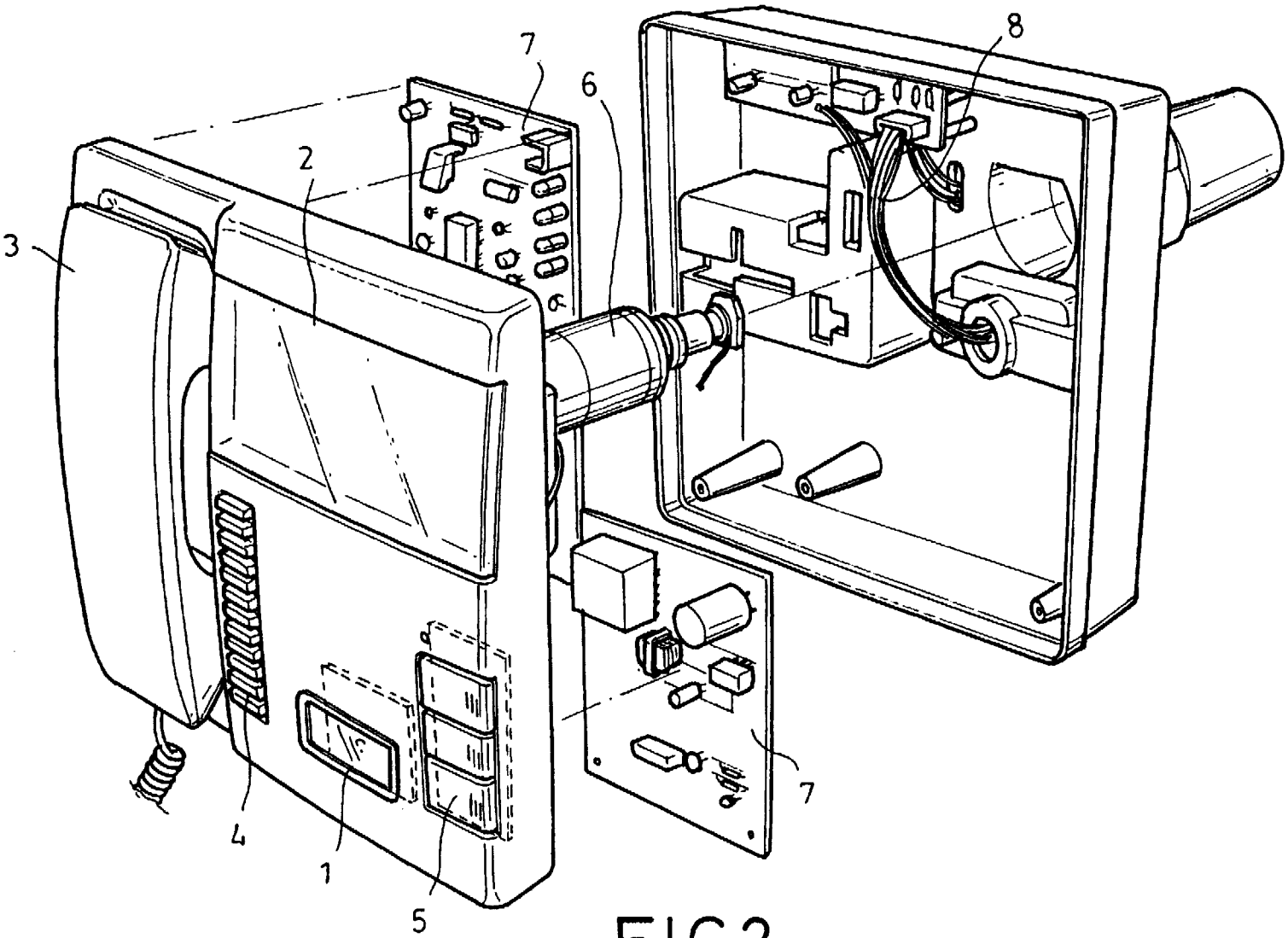
FIG. 2 is a perspective view of the supervising assembly made according to this invention.

The supervising assembly made according to this invention has a configuration of telephone set, as clearly shown in FIGS. 1 and 2. This supervising assembly generally includes a human being movement monitoring window 1, screen 2, a handset 3, a plurality of communicating keys 4, and controlling keys 5. The internal configuration of said supervising assembly includes a vacuum tube 6, printed circuit board 7, and a plurality of connecting wires 8. By the triggering of said communicating keys 4, the house holder can call the host computer or the other house holders which live in same building. Said controlling keys 5 are used to control the release of the front door or the switch on/off of said window 1. Said internal vacuum tube 6 is interconnected with said screen 2. The main features is on the printed circuit board 7 which integrates the anti-theft controller, video monitoring circuit, dialogue control circuit and human being movement detecting circuit, as shown in FIG. 3.

Said anti-theft controller integrates an anti-theft, flameproof, gas-leakage detecting capabilities. In case of accident, said sensor will issue a signal and said signal will be sent to the host computer of the control center via network. Accordingly, the guard can conduct a suitable reaction to those accidental cases. Said video monitoring circuit and screen 2 is interconnected to the camera located at the door, accordingly, the house holder can supervise the situation at the front door. On the other hand, said dialogue controlling circuit and handset 3 is also interconnected with the speaker/microphone disposed on the front door. By this arrangement, not only the house holder speak to the visitor at the front door, but also the house holder will speak to the guard at the control center or the other house holder lives in the same building. Besides, said infrared sensor and window 1 will detect any kind of heat emission within its scanning range. In case of a break-in, the alarm, speaker and LED indicators on-line will be triggered and the guard at the control center will be advised immediately.

Figure 3:
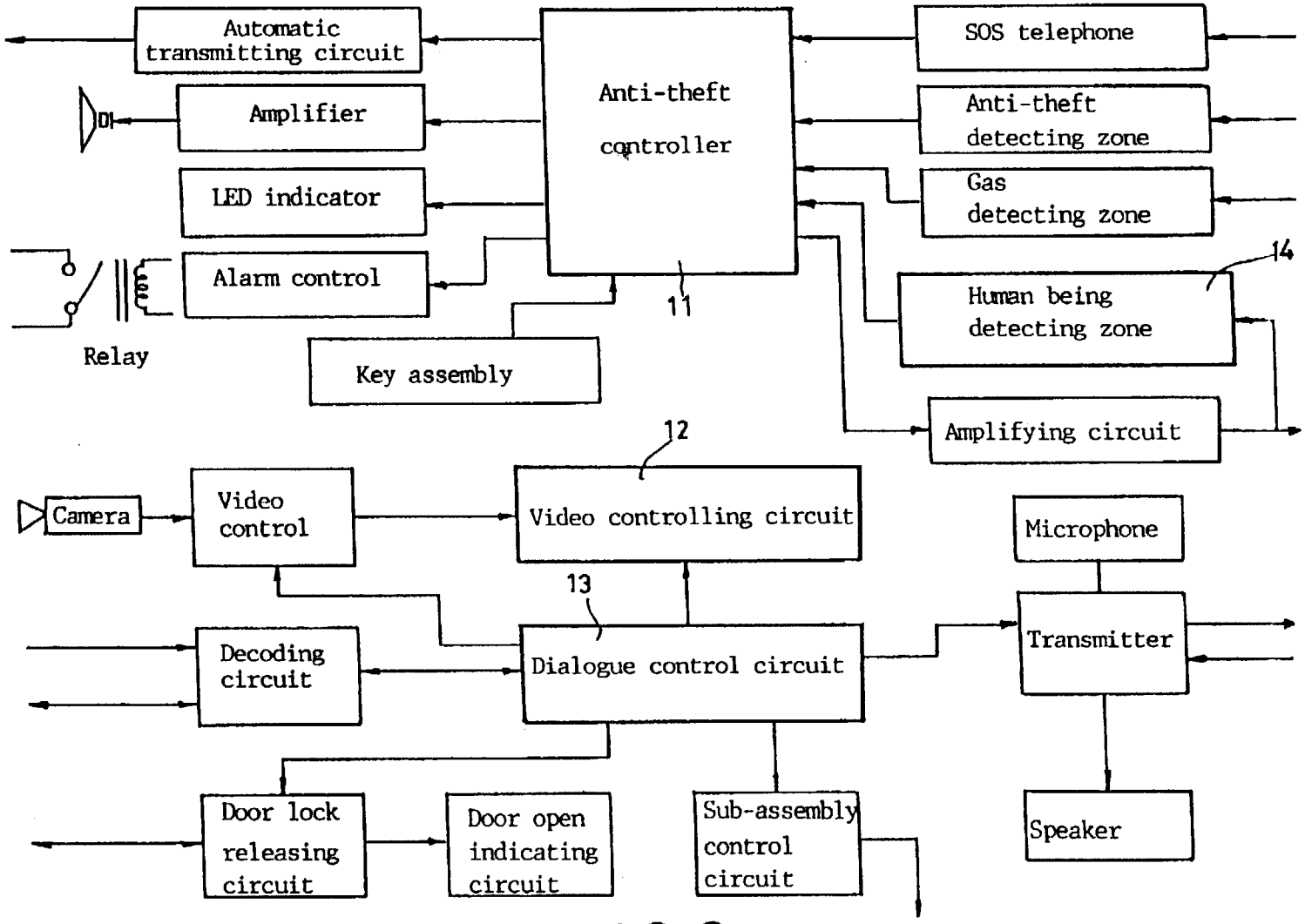
FIG. 3 is a block diagram of the circuitry of the supervising assembly made according to this invention.

Referring to FIG. 3, the block diagram of the circuitry of the supervising assembly made according to this invention. This circuitry generally includes an anti-theft controlling circuit 11, video controlling circuit 12, dialogue control circuit 13 and human being sensing circuit 14.

Said anti-theft controlling circuit 11 is interconnected to the SOS circuit, anti-theft detecting circuit, gas detecting circuit. All the signal received will be collected, analyzed, studied and communicated, then, the main host will make a suitable reaction, such as triggering an alarm, speaker and LED indicators. Furthermore, the host will also communicate this message on the network automatically. The host computer located at the control center will also record these data. Then the computer will make a suitable reaction.

Said video controlling circuit 12 is interconnected with a camera disposed at the front door. When the camera catches the situation on the front door, the video signal received will be transmitted to the screen 2 after the signal is processed by said vacuum tube and controlling circuit. Accordingly, the house holder may make a dialogue with the visitor at the front door.

Said dialogue control circuit 13 includes a controlling circuit, a microphone, a speaker and a transmitting circuit.

By this provision, the house holder may communicate with other house holder and the guard on control center in case of need.

Said human being sensing circuit 14 includes a monitoring window and detecting circuit. Said sensing circuit 14 can be connected with said anti-theft control system. Accordingly, when any intruder comes into the scanning range, a suitable reaction will be made to advise the house holder and threaten the break-in.

The multi-functional anti-theft supervising assembly can be concluded with the following features.

1. Each of the supervising assembly can be interconnected with other supervising assemblies and control center via network. Besides, the assembly can also connected with a host computer to record/retrieve data. The computer can make a suitable response based on the data it receives. The control can also supervise the situation on the front door and make a dialogue with the house holders. The front door can be opened via remote control.
2. This supervising assembly can collect, study and communicate the signal received indoors and outdoors. By the help of the network, the assembly can also communicate with the host computer.
3. The anti-theft controller is interconnected with a sound-effect speaker, alarm flash indicators and auto alarm system. In case a signal is received, said sound speaker will trigger a loud sound and the indicators will flash to alarm the guard as well as the house holder.
4. When a fire signal is received, a fire alarm will be triggered and the signal will be sent to the host computer located at the control center. The house holder can then evacuate from his house and wait for help.
5. In case a gas leakage is detected, an alarm will be triggered and the signal will be sent to the host computer located at the control center. The house holder can then evacuate from his house and wait for help.
6. When a SOS signal is issued from house holder in case of a heart attack or serious injury, the guard on control center will be advised immediately. Then the patient can receive the help at once.
7. The house holder can supervise the situation at the front door readily.
8. The house holder can make a dialogue with the visitor at front door or the guard at control center. He can release the door lock remotely.
9. This supervising assembly can receive a plurality of signals from variety of sensors, such as the touch-trigger sensor, supersonic sensor, heat sensor, infrared sensor, pressure sensor, camera sensor. As the signals received, the assembly will analyze, process, communicate and alarm.
10. This supervising assembly is provided with a window which can accurately supervise the movement within its scanning range. In case of any intruder, the sensor will send a signal to a designated destination. Accordingly, suitable reaction will be made.

Although this invention has been described in connection with a supervising assembly, it shall be understood that any modification or variation will be apparently to the skilled in the art and it shall still be included in the appended claim.

I claim:

1. A multi-function supervising assembly, comprising:

image providing means for providing images of a first remote site at a base site;

communication means for communicating between said base site and said first remote location and for communicating between said base site and a second remote location;

unlocking means for unlocking a door separating said base site from said first remote site in response to an unlocking signal generated at said base site;

control means for controlling said image providing means, said communication means and said unlocking means;

means for detecting a gas leak at said base site and for generating a gas leak signal indicative thereof;

means for detecting a fire at said base site and for generating a fire signal indicative thereof;

means for detecting the presence of a person in said base site and for generating a presence signal indicative thereof;

means for receiving an emergency signal from said second remote site; and warning means for producing a warning signal in response to said gas leak signal, said fire signal, said presence signal or said emergency signal.

2. The multi-function supervising assembly as defined by claim 1, further comprising:

receiving means for receiving said warning signal from said warning means, said receiving means being disposed at said base site.

3. The multi-function supervising assembly as defined by claim 2, further comprising:

alarm means for activating an alarm when said receiving means receives said warning signal from said warning means.

4. The multi-function supervising assembly as defined by claim 3, wherein:

said alarm means is disposed at said base site.

5. The multi-function supervising assembly as defined by claim 3, wherein:

said alarm means is disposed at said first remote site.

6. The multi-function supervising assembly as defined by claim 5, wherein:

said base site is an interior of a first house, said first remote site is outside said first house, said second remote site is an interior of a second house.

7. The multi-function supervising assembly as defined by claim 1, further comprising:

first and second receiving means for receiving said warning signal from said warning means, said first receiving means being disposed at said base site and said second receiving means being disposed at a third remote site.

8. The multi-function supervising assembly as defined by claim 7, wherein:

said second receiving means comprises a screen on which a message indicative of a signal received from said warning means is displayed.

9. The multi-function supervising assembly as defined by claim 8, wherein:

said base site is an interior of a first house, said first remote site is outside of said first house, said second remote site is an interior of a second house, and said third remote site is an interior of a guard house.

10. The multi-function supervising assembly as defined by claim 1, wherein:

said base site is an interior of a first house, said first remote site is outside of said first house, and said second remote site is an interior of a second house.

* * * * *